US005168640A

United States Patent [19]

Becerra

[11] Patent Number: 5,168,640

[45] Date of Patent: Dec. 8, 1992

[54] DRYER FOR SUGAR CANE BAGASSE AND/OR MEDULLA WITH A VERTICAL TYPE, MOBILE BED WITH COUNTERCURRENT WASTE COMBUSTION GASES

[75] Inventor: Carlos B. Becerra, Queretaro, Mexico

[73] Assignee: Centro de Investigacion y Asistencia Tecnica de Estado de Queretaro, A.C., Queretaro, Mexico

[21] Appl. No.: 707,761

[22] Filed: May 30, 1991

[30] Foreign Application Priority Data

Jun. 6, 1990 [MX] Mexico ..... 21023

[51] Int. Cl.[5] ..... F26B 19/00

[52] U.S. Cl. ..... 34/86; 34/174; 34/228; 34/166

[58] Field of Search ..... 34/86, 174, 211, 166, 34/168, 175, 176, 181, 182, 203, 218, 228, 227

[56] References Cited

U.S. PATENT DOCUMENTS 4,217,701 8/1980 Mathews ..... 34/211

4,294,019 10/1981 Seitmann ..... 34/211

*Primary Examiner*—Henry A. Bennet

*Assistant Examiner*—Denise L. F. Gromada

*Attorney, Agent, or Firm*—Finnegan, Henderson, Farabow, Garrett & Dunner

[57] ABSTRACT

This invention refers to a dryer for sugar cane bagasse and/or medulla with a vertical type, mobile bed with countercurrent waste combustion gases consisting of: a cylindrical body like a silo. The load is fed into the top of the cylindrical body and is then evenly distributed by spreading devices. Combustion gases from conventional boilers with a high energy content and normally considered as waste are fed countercurrently with the assistance of a ventilator into the bottom of the dryer through slots or holes. Once the gases have picked up humidity while going through the silo, they are expelled through the top by means of a conduct to the boiler's chimney. Inside the dryer, the bagasse and/or medulla is moved slowly and constantly along Archimedes conveyors vertically, radially and rotating thus permitting broad exposure to the combustion gases, the dryer is further characterized because the vertical Archimedes conveyors are designed to have a varied pace, longer at the top and shorter at the bottom, that provides a bigger mix of the mobile bed at the top than at the bottom, thereby achieving a larger stratification in the bottom of the bed. It is also characterized because the mobile bed of bagasse and/or medulla acts in turn as a filtering element that retains the particles derived from the combustion gases making it possible to use less energy than in the known systems, providing longer residence and reducing the environmental pollution caused by combustion.

6 Claims, 2 Drawing Sheets

DRYER FOR SUGAR CANE BAGASSE AND/OR MEDULLA WITH A VERTICAL TYPE, MOBILE BED WITH COUNTERCURRENT WASTE COMBUSTION GASES

BACKGROUND OF THE INVENTION

Sugar cane bagasse is excellent organic material of fuel for boilers that can substitute other types of energy providing fuels in sugar mills. However, its disadvantage is that is has a high humidity content and for this reason different types of drying equipment have been designed, some with a sophisticated design and others that are not very efficient.

The best known dryers for this type of operation are those with a type of rotating drum, pneumatic transport, fluidized bed and exposure to the heat of the sun; the first three provide direct or indirect contact between the material to be dried and the combustion gases.

American patente U.S. Pat. No. 4,326,470 protects a pneumatic type of bagasse dryer; it describes a design in which combustion gases from the boiler are used and is characterized because it decreases the amount of humidity of the bagasse by 10 to 15% and permits an increase in steam production in the boiler of between 13.5 and 15.45% respectively. It can be seen from this system that heat exchange times are short, meaning that the decrease in the percentage of humidity can be no greater; it also has the disadvantage of high energy consumption in transporting the material.

SUMMARY OF THE INVENTION

This invention refers to a dryer for sugar cane bagasse and/or medulla with a vertical type, mobile bed with countercurrent waste combustion gases in which the bagasse and/or medulla is fed into the top by means of feeders and spreaders that evenly distribute it over the whole area. The silo or in side of the dryer is partially full of bagasse and/or medulla that goes out through the bottom as the desired percentage of humidity is reaches. The top of the silo has a structure which supports the motors that move a certain number of Archimedes conveyors placed vertically next to the bagasse and/or medulla. Apart from a spinning movement on their own axis, these conveyors rotate around the silo's vertical axis and also move radially, thus making it possible to ensure close contact between the bagasse and/or medulla and the combustion gases; when dried to the desired percentage of humidity dependihg on length of stay, the bagasse and/or medulla leaves the silo by the central bottom with the help of a certain number of Archimedes conveyors placed horizontally and radially near the slotted bottom that spin around the silo's axis and on their own axes, carrying the material from the periphery to the center of the silo. The number of Archimedes conveyors will depend on the diameter of the silo. Similarly the unloading rat controlled by a dosimeter at the exit from the dryer will depend on the desired humidity and the consumption of dry bagasse required by the boiler. The bagasse and/or medulla is collected in the bottom by means of an Archimedes conveyor that takes it to the boiler's furnace, to a warehouse or to some other later process such as (peletizade).

The bagasse dryer works on the principal of the combustion gases travelling countercurrent in relation to the direction of the bagasse and/or medulla, thus ensuring greater transmission of mass and energy.

The combustion gases from the boiler are fed into the bottom of the silo which has a plenum that provides adequate distribution of the gases along the floor which is grooved and has slits making it possible for the combustion gases to move in one direction while avoiding the bagasse and/or medulla moving in another.

It is therefore an objective of this invention to provide a dryer for sugar cane bagasse and/or medulla with a vertical type, mobile bed wiht countercurrent waste combustion gases from a boiler in which the system of countercurrent heat and mass transmission allows for an increase in thermal efficiency.

Another of the objectives of this invention is to provide a dryer in which the mobile bed acts in turn as a filtering element within the silo thus permitting the particles derived from the combustion of the combustion gases to be retained by that same bed avoiding their expulsion into the atmosphere.

By means of this design for a dryer, when the combustion gases with particles go by countercurrent to the bed, the bed is able to act as a filtering element for the particles which again form part of it and therefore return with the bed to the combustion process where they have a second opportunity to complete their combustion or to become ashes, and in this way combustion efficiency is improved.

One more objective of this invention is to provide a dryer in which the bagasse and/or medulla falls by means of gravity thus considerably reducing energy consumption.

A further objective of this invention is to provide a dryer in which a system of vertical ducts with spaces between them, connected to the lower plenum, is placed against the inside of the outside covering, extending to the level of the top most bed and with perforations for the hot gases to circulate, thus allowing the external part of the silo to become hot and so eliminate water condensation, markedly reducing corrosion of the outside cover and avoiding the bagasse and/or medulla forming soggy layers on the cover's surface.

The applicant has designed a sugar cane bagasse and/or medulla dryer with a vertical type mobile bed, with waste combustion gases that makes it possible to use less energy and longer residence in which the material being dried is extracted from the bottom of the silo (dryer) and directly fed to the boilers as fuel.

DETAILED DESCRIPTION OF THE INVENTION

The invention refers to a sugar cane bagasse and/or medulla dryer with a countercurrent vertical type mobile bed, like a silo, which uses waste combustion gases from a conventional boiler.

The dryer is characterized because it consists of a cylindrical body, like a silo, with a cone - shaped, upper and supported on a concrete base, it has in addition chamber for the distribution of intermediate combustion gases between the concrete base and the lower perforated or slotted floor of the dryer; it also includes a cylindrical structure. Similarly, it has elements inside that spread out the product to be dried by means of a series of Archimedes conveyors together with two dosimeters and product and combustion ga feeder ducts.

The invention is described below in greater detail in accordance with the drawings shown in FIGS. 1 and 2 in order to better illustrate it in its modalities but without restricting its scope.

Figure 1:
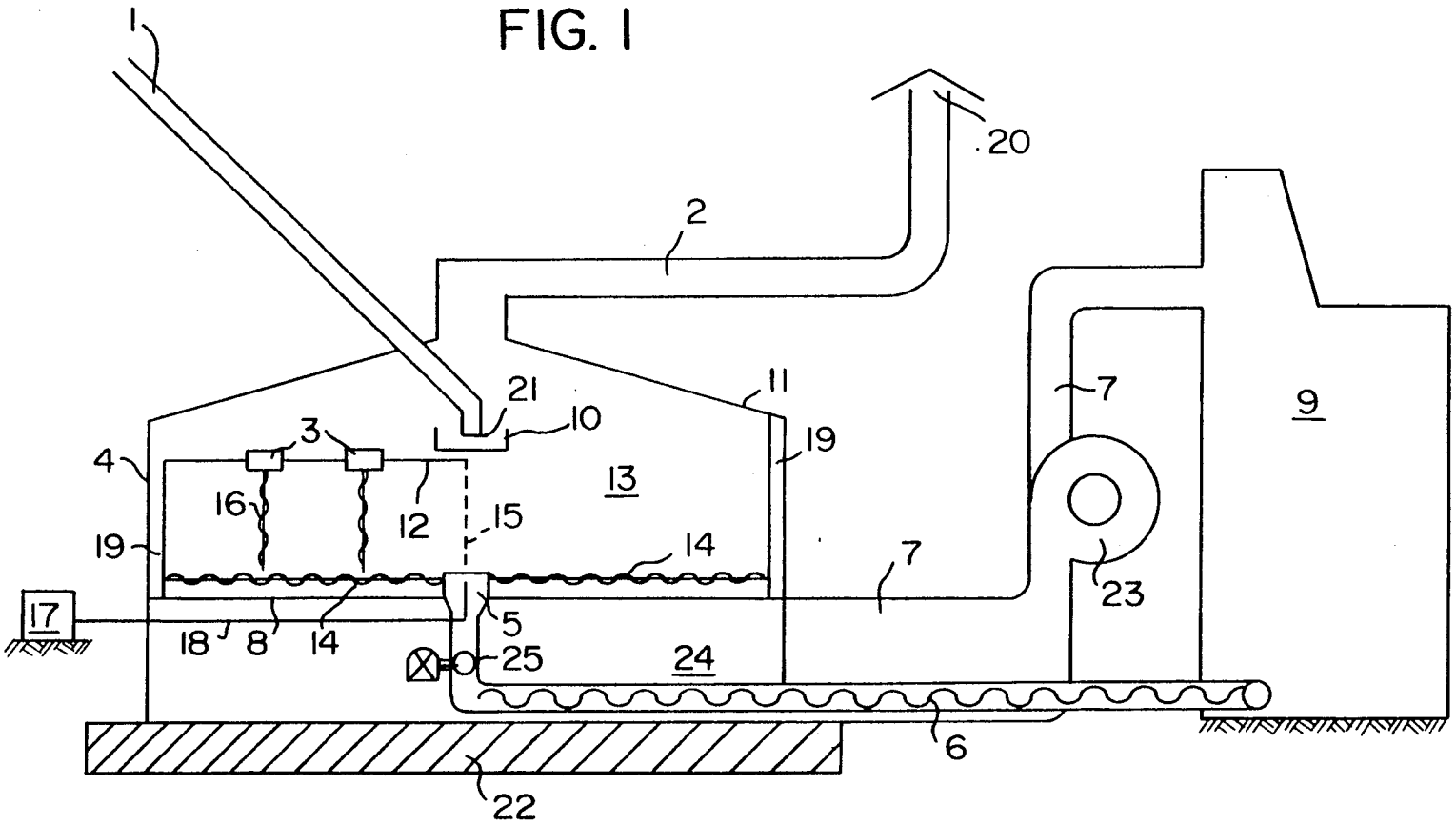
FIG. 1 shows a side view with a transversal cut of the bagasse and/or medulla dryer joined to a conventional boiler.
Figure 2:
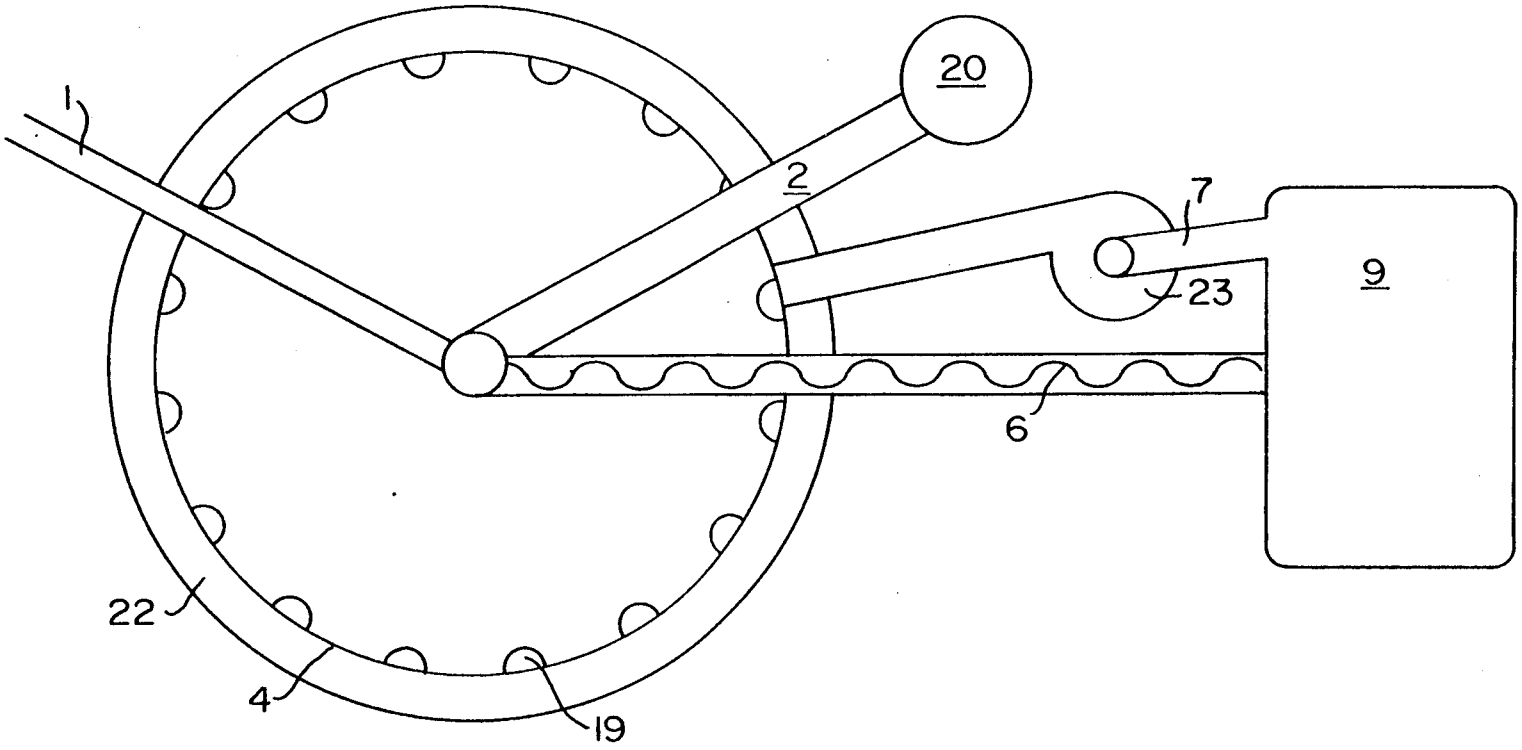
FIG. 2 shows an overhead view of the proposed bagasse and/or medulla dryer.

The dryer for bagasse and/or medulla is of a vertical type and is characterized because it has a mobile bed and is made up of a cylindrical covering 4 FIG. 1 in a metallic material whose upper part finishes with a conical roof 11 in order to avoid materials and water accumulating, similarly the highest part of the roof 11 has an exit duct 2 for the humidity laden combustion gases which are sent to the chimney 20 of a conventional boiler 9. The bottom of the dryer corresponds to a concrete base 22 on which the silo is set, a pipe 1 is located at the top of the conical roof 11 and takes the material to be dried, the material in turn goes through the dosimeter 21 and is then fed into a spreader element 10 so that all the material can be evenly distributed over the entire surface of the silo. The dosimeter 10 also has the function of preventing combustion gases escaping along the duct 1. The bagasse and/or medulla is fed into the silo or rather the inside of the dryer 4 through the duct 1 and after having been measured out in order to keep the height of the bed constant is then distributed by means of a system of Archimedes conveyors 14 at the bottom of the silo, 4, that spin around the central axis 15 and on their own axes, collecting the material from the center of the silo 4 and sending it inmediately to a dosimeter 25 that controls the amount of combustible material depending on the demand for steam required in the boiler for the process, from there it is unloaded into the conveyor 6 and subsequently sent for combustion to the boiler's furnace 9 or for storage or to a subsequent peletizade process.

Similarly, it has a gear box 5 that receives the mechanical movement through the shaft 18, this movement is provided in turn by a driving element 17 located outside the dryer. The lower floor 8 of the dryer 4 is a plate with perforations and slots through which the combustion gases go on their way to the top of the silo 4 where they are collected and sent along the pipe 2 to the chimney 20. In the middle of the silo there is mobile control bar 12 which supports the electic motors 3 that move the Archimedes conveyors 16 which spin on their own axis thus permitting the bagasse and/or medulla to move from the bottom to the top.

The motors 3 assembled on the control bar 12 are attached in such a way that they can move radially on the bar making it possible to operate the whole volumme of the product to be dried that is present in the silo. The bar 12 spins around the axis 15 permitting the Archimedes conveyors to completely expose the bagasse and/or medulla to the combustion gases.

The combustion gases from the boiler are fed by means of a ventilator 23 and the pipe 7 to a chamber or (plenum) 24 located at the bottom of the silo between a concrete base 22 and the bottom floor which is the perforated plate 8; in this chamber the combustion gases are evenly distributed. The whole silo or drying tower is perfectly sealed to avoid the combustion gases leaking out.

By means of the design for this dryer when the combustion gases with particles go by countercurrently to the bed, the bed acts as a filtering element for the particles which go back to the bed and as a result return with the bed to the combustion process thus having a second chance to complete their combustion or become part of the ashes and thereby improving combustion efficiency.

What is claimed is:

1. A dryer for sugar cane material comprising a housing having an outer cylindrical wall, a closed conical top, and a perforated floor forming an interior chamber, means for feeding and controlling the amount of material to be dried to said chamber and for spreading it evenly over the floor of the housing, a plenum located below said floor of receiving hot gases and distributing it up through said perforations into said chamber, a horizontal bar located above the height of the material in the chamber and mounted for rotary movement about the central axis of the housing, means for rotating said bar, a first set of vertically oriented corkscrew conveyors mounted on said bar that extend downwardly into said material in said chamber, means for rotating said first set of conveyors about their own axes and for translating them back and forth along said bar in a radial direction to mix up the material in the chamber and expose it to said gases and a second set of horizontally oriented corkscrew conveyors extending radially outward from the central axis of the housing adjacent the floor, means for rotating said second set of conveyors about their own axes and for translating them around said central axis to convey dried material toward an exit opening in the floor of the housing, where the dried material is discharged from the chamber.

2. The dryer of claim 1, wherein the means for feeding and controlling the material to be dried to the chamber comprises a feeder pipe extending through the top of the housing for feeding the material into the chamber by gravity and a dosimeter device that controls the amount of material spread over the floor of the housing.

3. The dryer of claim 1, in combination with a boiler for generating hot waste combustion gases and having a chimney, including means for feeding said waste gases to said plenum and means for feeding dried material from said dryer to said boiler and a duct connecting the interior of the top of the chamber to said chimney for exhausting spent gases from said dryer.

4. The dryer of claim 1, wherein the horizontally oriented corkscrew conveyors convey the dried material toward an exit opening in the center of the floor of the housing.

5. The dryer of claim 1, wherein the vertically oriented corkscrew conveyors rotate in a direction that moves the material from the bottom towards the top of the chamber.

6. The dryer of claim 1, including a plurality of vertical ducts spaced around the interior surface of the wall of the housing and connected to said plenum for heating the walls of the housing and having perforations therein for further distributing the hot gases into said chamber and through said material.

* * * * *

UNITED STATES PATENT AND TRADEMARK OFFICE

CERTIFICATE OF CORRECTION

PATENT NO. : 5,168,640

DATED : December 8, 1992

INVENTOR(S) : Carlos B. Becerra.

It is certified that error appears in the above-identified patent and that said Letters Patent is hereby corrected as shown below:

On the title page:

Delete the Abstract in its entirety and substitute therefor

--[57] ABSTRACT

A dryer for sugar can bagasse or medulla material including a housing having an outer cylindrical wall, a closed conical top, and a perforated floor forming an interior chamber. A series of devices are provided for feeding the material to be dried to the chamber and spreading it evenly over the floor of the housing. A plenum located below the floor receives hot waste combustion gases from a boiler and distributes it up through the perforations into the chamber. A horizontal bar, located above the height of the material in the chamber and mounted for rotary movement about the central axis of housing, supports a first set of vertically oriented corkscrew conveyors that extend downwardly into the material in said chamber. The conveyors turn about their own axes and translate back and forth along the bar in a radial direction to mix up the material in the chamber and expose it to the gases. A second set of horizontally oriented corkscrew conveyors extend radially outward from the central axis of the housing adjacent the floor that also rotate about their own axes as well as translate around the axis to convey dried material toward an exist opening in the middle of the floor of the housing, to discharge it from the dryer.--

UNITED STATES PATENT AND TRADEMARK OFFICE

CERTIFICATE OF CORRECTION

PATENT NO. : 5,168,640

DATED : December 8, 1992

INVENTOR(S) : Carlos B. Becerra

It is certified that error appears in the above-indentified patent and that said Letters Patent is hereby corrected as shown below:

Claim 1, column 4, line 17, change "of" to --for--.

Signed and Sealed this

First Day of February, 1994

Bruce Lehman

*Attest:*

BRUCE LEHMAN

*Attesting Officer*

*Commissioner of Patents and Trademarks*